United States Patent [19]

Heuzonter

[11] 4,151,620

[45] May 1, 1979

[54] WINDSHIELD AND STRUCTURES FORMED THEREFROM

[75] Inventor: Eduard Heuzonter, Linz, Austria

[73] Assignee: Semperit Aktiengesellschaft, Vienna, Austria

[21] Appl. No.: 766,337

[22] Filed: Feb. 7, 1977

[51] Int. Cl.[2] ..... B63B 17/00

[52] U.S. Cl. ..... 9/1.5; 296/84 A; 296/84 D

[58] Field of Search ..... 296/84 A, 84 D, 89, 296/90, 87; 9/1.5

[56] References Cited

U.S. PATENT DOCUMENTS

| | | | |
|---|---|---|---|
| 3,829,153 | 8/1974 | Fussell et al. | 9/1.5 |
| 3,978,535 | 9/1976 | Swan | 9/1.5 |

*Primary Examiner*—Richard A. Bertsch

*Attorney, Agent, or Firm*—Werner W. Kleeman

[57] ABSTRACT

A windshield for vehicles, especially inflatable boats or the like, comprising a rigid frame, the lower leg of which is provided at its outer side or surface with a longitudinal groove possessing undercut portions and serving to receive a complementary structural member, typically a profile member, secured to the vehicle chassis, especially the body or hull of the boat or otherwise.

7 Claims, 7 Drawing Figures

WINDSHIELD AND STRUCTURES FORMED THEREFROM

BACKGROUND OF THE INVENTION

The present invention relates to a new and improved construction of a windshield for vehicles, especially but not exclusively inflatable boats or the like, and to structures formed from combinations of such windshields.

There have already become known to the art various proposals for attaching windshields to a vehicle which consists of a flexible material at least at the region where the windshield is to be attached. An example thereof is the attachment of a windshield at an inflatable boat. In this connection it is known to provide a construction wherein the windshield possesses holes at the region of its lower edge, through which there can be inserted nipples which are attached to the boat hull or body. These nipples in turn possess holes through which there can be inserted a rod. The attachment of the windshield must be accomplished in the non-inflated condition of the boat and a final positional fixation thereof is then first carried out with the inflation of the boat.

This technique of mounting the windshield is associated with a number of drawbacks: it is relatively complicated, and furthermore, there is required a filigree-type connection technique, so that, on the one hand, assembly requires a relatively great amount of time, and, however, on the other hand, the obtained strength of the assembled structure is low. A further essential drawback resides in the fact that a windshield attached in this manner, if it is not additionally retained and supported, is unable to maintain its position to the extend desired when travelling at greater speeds. Consequently, deformation of the windshield results, and, in the extreme case, it can happen that the vision of the driver is impaired. Also, with the above discussed construction, it is not possible to provide the windshield in the required desired size, in order to afford optimum protection against wind and water spray, since otherwise its mechanical fixation is associated with difficulties.

SUMMARY OF THE INVENTION

With the foregoing in mind it is therefore a primary object of the present invention to provide an improved construction of windshield which is not associated with the aforementioned drawbacks and limitations prevailing with the prior art constructions.

Another and more specific object of the present invention aims at the provision of a new and improved windshield which can be simply mounted and when mounted retains its desired position free of deformation, even when encountering relatively high travel speeds.

Yet a further significant object of the present invention aims at the provision of a novel windshield for various vehicle constructions, particularly suitable but not limited for use in conjunction with boats and the like, and which is relatively simple in construction and design, economical to manufacture, and quite easy to mount so as to be positionally stable at the vehicle.

Now in order to implement these and still further objects of the invention, which will become more readily apparent as the description proceeds, the windshield of the present invention is manifested by the features that there is provided a rigid frame, wherein at least the lower leg of the frame is equipped at its outer side or surface with a longitudinal groove having undercut portions and serving to receive a complementary formed profile or structural member connected to the vehicle chassis, especially the boat body or hull.

This construction of windshield enables mounting the same at already fabricated boats, so that there is no need to be concerned about damaging the windshield during construction of the boat or otherwise. The windshield attached in the frame, in order to mount the same, is simply pushed onto the profile or structural member, resulting immediately in an exact positional fixation of the lower edge of such windshield. With this fixation technique there is also beneficially eliminated the possibility of water seeping below the windshield edge and undesirably impairing the vision of the user.

A particularly good fixation of the windshield at the vehicle chassis, especially at the boat body or hull, can be obtained if the longitudinal groove is constructed so that it possesses a substantially T-shaped cross-sectional configuration. Hence, the mirror image or complementary formed profile or sectional member likewise possesses a substantially T-shaped cross-sectional configuration.

If the front pane of the vehicle is composed of a number of windshields, then care must be taken to ensure that such can be simply installed in the same manner. In this case it is advantageous if the longitudinal groove is constructed so that in cross-section it possesses a substantially circular shape, because then the windshield can be rocked or pivoted about the likewise circular shaped profile or structural member, providing the advantage that there does not occur any mutual hindrance during installation.

Also, in case the front pane is assembled from a number of windshields, then it is advantageous if the lateral legs of the frames of adjoining or adjacent windshields also possess a respective longitudinal groove possessing undercut portions. In this way there can be provided a profile rod which is commonly insertable into the longitudinal grooves for positively interconnecting such neighboring or adjacent windshields. Due to this connection technique which is provided for adjacent windshields, it is not only possible to increase the inherent rigidity or strength of the windshield structure composed of a combination of windshields, but at the same time it is also possible to obtain a good sealing action at the connection location. Furthermore, this manner of assembly is extremely simple and can be carried out quite easily even by unskilled individuals. What is further advantageous is that it is not absolutely necessary to maintain the connection components or elements clean to any extreme degree in order to obtain the desired functionality of the connection elements.

In order to facilitate as much as possible the construction of an inflatable boat or other appropriate vehicle, it is advantageous if the profile member is connected with the vehicle chassis, especially the boat hull, by an adhesive bond, vulcanization or the like. As a result, the position of the profile member and thus also the windshield is fixed right from the start, and there is not required any additional manipulation in order to achieve the correct position. In the case of larger vehicles, where greater requirements prevail when there is desired an additional disassembly possibility for the windshield, it can however also be advantageous if the profile member is detachably connected in any suitable way with the vehicle chassis, especially the boat body or hull. This detachable connection can be accomplished, for instance, by screws, bolts, or conventional quick-fastening devices. To reduce the possible danger of accidents occurring at the frame of the windshield, it is desirable if also the upper leg of the frame possesses a longitudinal groove having undercut portions for the reception of a protective profile member formed of rubber, plastic or the like. This is especially advantageous when using a combination of windshields, i.e. a structure formed from a number of such windshields, because then the protective profile or structural member can be simultaneously pushed through all of the upper longitudinal grooves, and thus, also covers and protects the connection locations and corners.

In order to obtain an adequate fixation of the windshield, even in the case of high horsepower boats up to 45 hp, for every speed thereof, it is advantageous if there is provided a windshield combination or structure which consists of two front panes or windows which adjoin one another at an optuse angle, followed by both sides thereof by side panes or windows. The front windows or panes and the side windows or panes are interconnected by means of a profile member with the boat body or hull, which profile member is secured to the latter, and which panes are attached to one another by means of profile rods. The tendency of the windshield to incline when encountering pronounced wind loads during travel, is practically completely eliminated with this construction by virtue of the fact that the inclination forces are directly transmitted to and taken up by the boat hull by means of the side or lateral windshields.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
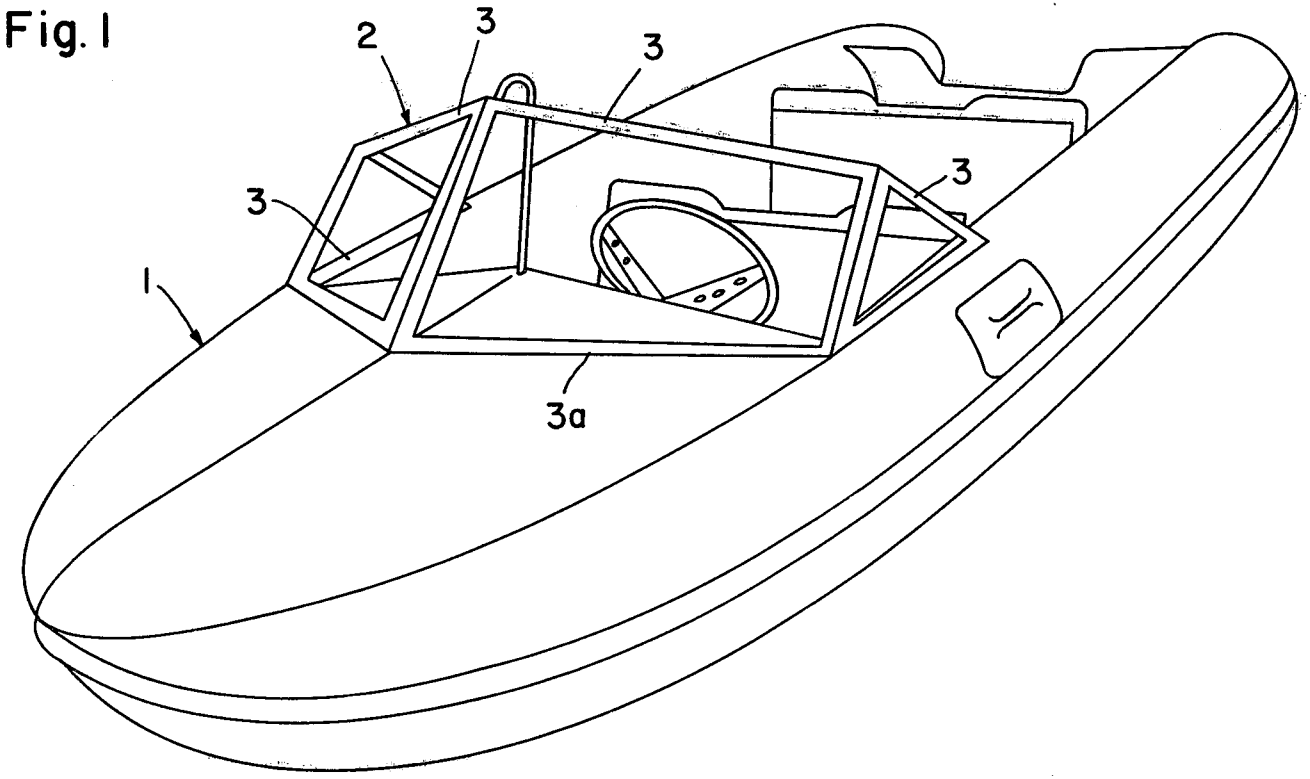
FIG. 1 illustrates by way of example a perspective view of a vehicle, here shown as an inflatable boat, at which there is mounted a windshield constructed according to the present invention.
Figure 2:
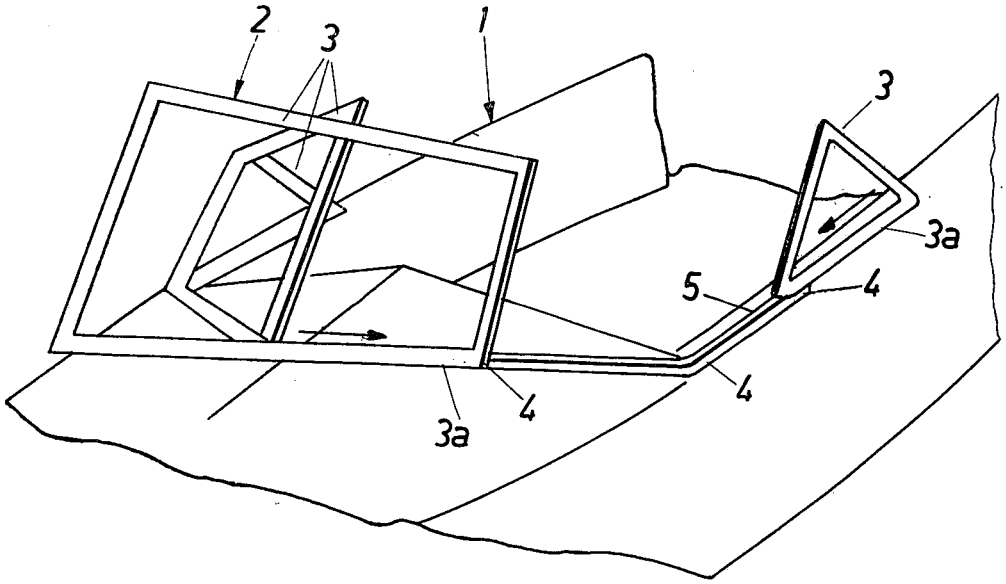
FIG. 2 illustrates the insertion operations performed upon the windshield when mounting the same.
Figure 4:
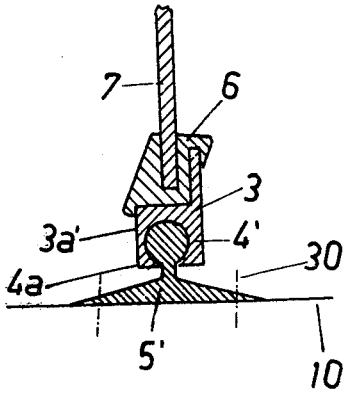
FIG. 4 illustrates in sectional view a modified attachment means for connecting the windshield at the boat body or hull.
Figure 3:
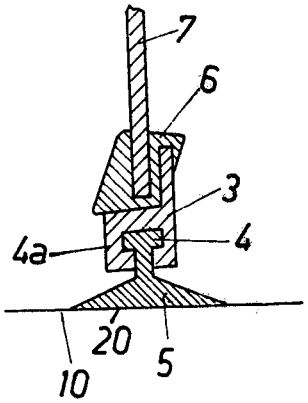
FIG. 3 illustrates in sectional view a detail of the attachment means for connecting the windshield with the boat body or hull.

Describing now the drawings, in FIG. 1 there is shown by way of example a vehicle in the form of an inflatable boat 1 possessing windshields 2 equipped with the frames 3. As best seen by referring to FIG. 2, at the location where it is intended to mount the windshield 2, there is attached in any convenient fashion, such as by providing an adhesive bond or by vulcanization, as generally indicated in FIG. 3 for instance by reference character 20, a structural or profile member 5. The frame 3 of each windshield 2 is pushed in the direction of the arrow of FIG. 2 onto the profile member 5 by means of a longitudinal groove 4 formed at its lower frame leg 3*a* at the outer side or surface thereof. Of course, if desired the profile member 20 can be connected to the boat body or hull 10 in a different way, such as by screws, bolts, quick-fastener devices or the like, as generally indicated in FIG. 4 by reference character 30.

As best seen by referring to FIG. 3, the profile or structural member 5 can be constructed, viewed in cross-section, to possess a substantially T-shaped configuration and thus engages with the complementary or mirror image formed longitudinal groove 4 having the undercut portions 4*a*. By referring to the modified construction shown in FIG. 4, the longitudinal groove 4' (also having the undercut portions 4*a*) can possess, at the lower leg 3*a'* of the frame 3, a substantially circular shaped cross-sectional configuration. The profile member 5' is then constructed to be correspondingly complementary in shape. As mentioned, the profile members 5 and 5' may be vulcanized to the associated boat body or hull 10. As also readily discernible by referring to FIGS. 3 and 4, the pane or window 7 is secured in the frame 3 by means of a glass-retaining profile member 6.

Figure 5:
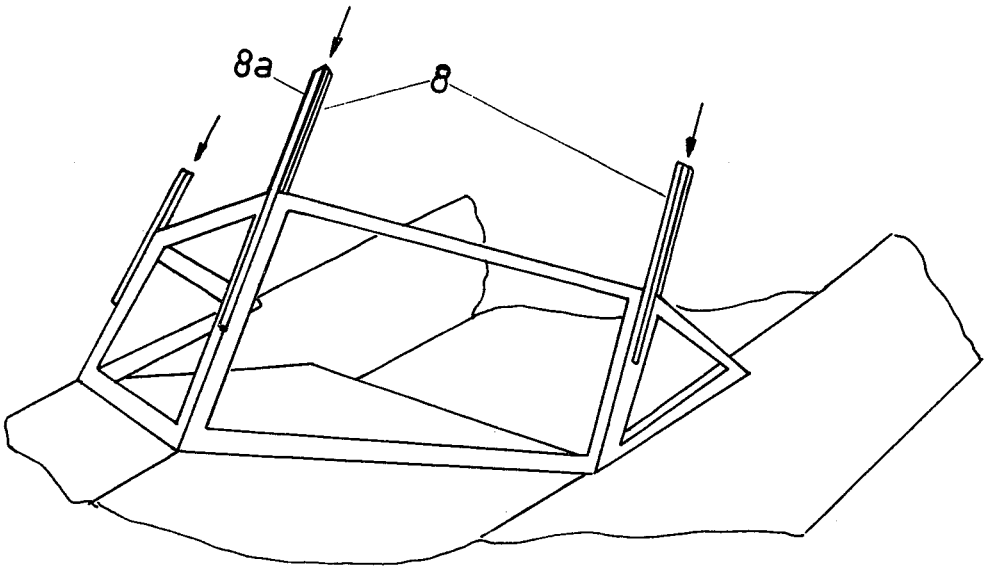
FIG. 5 further illustrates details of the connection of the windshield at the boat body or hull.
Figure 6:
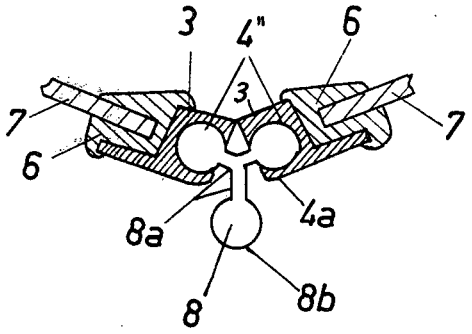
FIG. 6 illustrates in sectional plane view details of the attachment or connection arrangement of FIG. 5.

Now in FIGS. 5 and 6 there is illustrated the use of a respective profile rod 8 for interconnecting adjoining windshields. Each profile rod 8 will be seen to comprise, looking at the cross-section thereof, three legs 8*a* which are angularly offset through about 120° from one another, and possessing at their ends a substantially circular-shaped enlarged portion 8*b*, by means of which they engage into the associated longitudinal groove 4'' of the frame 3. As particularly well recognized from the illustration of FIG. 5, the assembly of each profile rod 8 is accomplished first after mounting the windshield 2 and simply by insertion thereof into the longitudinal grooves 4'' having the undercut portions 4*a*.

Figure 7:
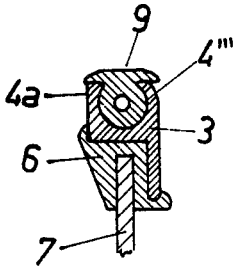
FIG. 7 illustrates in sectional view the upper edge of a windshield constructed according to the invention.

Finally, FIG. 7 shows in cross-section the attachment of a protective profile member 9, formed of rubber or plastic for instance, in the longitudinal groove 4''' of the frame 3. The protective profile member 9 is likewise constructed at the region of its engagement with the longitudinal groove 4''', viewed in cross-section, to possess a substantially circular sectional configuration. The part protruding from the longitudinal groove 4''' at the region of the undercut portions 4*a* thereof is constructed to be substantially cap-shaped in configuration in order to cover the frame 3. To facilitate the assembly of the protective profile member 9 the same possesses a hollow construction to permit slight deformation thereof.

While there are shown and described present preferred embodiments of the invention, it is to be distinctly understood that the invention is not limited thereto, but may be otherwise variously embodied and practiced within the scope of the following claims.

Accordingly, what I claim is:

1. A windshield anchoring for an inflatable boat comprising at least two rigid windshield frames each having upper and lower frame legs and lateral frame legs, longitudinal grooves having undercut portions formed in the outer surfaces of the lower frame legs and at least one lateral frame leg of each frame, a first profile member formed of a vulcanizable material and attached by vulcanization to the inflatable boat, said first profile member having a configuration complementary to the longitudinal groove in said lower frame legs, the longitudinal grooves of said lower frame legs of said two frames being connected to said first profile member with said one lateral frame leg of each frame in confronting relation, a second profile member having a configuration complementary to the longitudinal grooves in each of said one lateral frame legs, said second profile member being connected to both the longitudinal grooves of said one lateral frame legs.

2. The windshield anchoring as defined in claim 1, wherein said undercut portions have substantially T-shaped cross-sections.

3. The windshield anchoring as defined in claim 1, wherein said undercut portions have substantially circular cross-sections.

4. The windshield anchoring as defined in claim 1, wherein the upper frame legs of each frame are provided with longitudinal grooves having undercut portions, a protective profile member having a configuration complementary to the longitudinal grooves of the upper frame legs and connected thereto.

5. The windshield anchoring as defined in claim 4, wherein said protective profile is formed or rubber.

6. The windshield anchoring as defined in claim 4, wherein said protective profile is formed of plastic.

7. A windshield anchoring for an inflatable boat comprising at least two rigid windshield frames each having upper and lower frame legs and lateral frame legs, longitudinal grooves having undercut portions formed in the outer surfaces of the lower frame legs and at least one lateral frame leg of each frame, a first profile member adhesively attached to the inflatable boat, said first profile member having a configuration complementary to the longitudinal groove in said lower frame legs, the longitudinal grooves of said lower frame legs of said two frames being connected to said first profile member with said one lateral frame leg of each frame in confronting relation, a second profile member having a configuration complementary to the longitudinal grooves in each of said one lateral frame legs, said second profile member being connected to both the longitudinal grooves of said one lateral frame legs.

* * * * *